United States Patent [19]

Leonhart

[11] 4,242,967

[45] Jan. 6, 1981

[54] SEPARATELY USEABLE PULL-OUT TABLE LEAF

[76] Inventor: Xaver F. Leonhart, 8381 Harburg, near 8385 Pilsting, Ndb., Fed. Rep. of Germany

[21] Appl. No.: 56,727

[22] Filed: Jul. 11, 1979

[30] Foreign Application Priority Data

Aug. 5, 1978 [DE] Fed. Rep. of Germany ..... 2834469

[51] Int. Cl.[3] ..... A47B 1/04

[52] U.S. Cl. ..... 108/11; 108/69; 108/79; 108/124

[58] Field of Search ..... 108/124, 121, 115, 69, 108/65, 79, 64, 78, 66, 11

[56] References Cited

U.S. PATENT DOCUMENTS

| | | | |
|---|---|---|---|
| 899,383 | 9/1908 | Canniff | 108/124 |
| 2,191,007 | 2/1940 | Bussey | 108/115 X |
| 2,692,175 | 10/1954 | Jacques | 108/124 |
| 2,738,244 | 3/1956 | Ferguson | 108/11 |
| 3,185,114 | 5/1965 | Consin | 108/65 |
| 3,308,773 | 3/1967 | Long | 108/79 |

*Primary Examiner*—Francis K. Zugel

*Attorney, Agent, or Firm*—Brady, O'Boyle & Gates

[57] ABSTRACT

A rectangular body portion is hinged along its end edge by first hinges to the bottom of a pull-out table end leaf and is movable from a position parallel with the leaf to a position normal to the leaf. A pair of U-shaped support legs which serve as slides for connecting the end leaf to an extension table are hinged to opposite side edges of the body portion and are separately pivotal from a common plane parallel with the body portion to positions at acute angles with the body portion and have latches thereon for interlocking engagement with latch plates to hold the U-shaped support legs in position to support the table leaf as a separate assembly. A portion of the top of the table end leaf is hinged to pivot upward and be locked in the raised position by a bracket to form the back of a child's bench.

9 Claims, 6 Drawing Figures

SEPARATELY USEABLE PULL-OUT TABLE LEAF

FIELD OF THE INVENTION

The invention is directed to a pull-out table leaf that, beside its use as a leaf extension on the end of an extension table, can also be used independently from the table as a low side table or a child's bench.

Pull-out table end leaves of prior art extension tables function essentially to increase the surface area of the extension table. When the larger table surface is not in use, these end extension leaves are retracted and stored under the main table top of the extension table and cannot be used for any other purpose.

BACKGROUND OF THE INVENTION

The purpose of this invention is to redesign existing pull-out table end leaves so that besides being used as conventional pull-out end leaves to increase the surface of the table, they can be removed from the table and separately used both as side tables and as benches for children and still be retracted under the ends of the table like conventional pull-out table end leaves, when they are not in use.

SUMMARY OF THE INVENTION

The purpose is achieved through the invention by the use of two U-shaped supports whose legs are the slide members that connect the pull-out table leaf to the end of an extension table in the usual manner, and which become the legs of a separate table or bench with four legs; of a rectangular auxiliary leaf whose sides are linked by means of hinges with the U-shaped supports in such a way that the edges of adjacent legs of both of the U-shaped supports almost touch each other when the U-shaped supports are positioned in the same plane by pivoting them about the hinges into a plane parallel with the auxiliary leaf; of hinges on the end of the auxiliary leaf that faces the main table leaf, the auxiliary leaf being fastened to the bottom of the main table leaf in such a way that the auxiliary leaf is positioned immediately below its center of gravity and parallel to the edge of the main table leaf and the end edge of the table top, and that when the auxiliary leaf is pivoted about its hinges from a position normal to the main table leaf to its folded position parallel therewith, its legs extend beyond the edge of the main table leaf and function as the slide members that connect the pull-out table leaf to the end of the extension table in the normal manner; latch plates with catches thereon positioned on the bottom surface of the main table leaf to hold the U-shaped supports when used as table legs in their extended positions pivoted out of the same plane; and one latch on each U-shaped support leg that engages behind the catch of the respective latch plate to lock the legs in position for supporting the main table leaf as a separate side table or bench.

DESCRIPTION OF THE PREFERRED EMBODIMENTS

Figure 1:
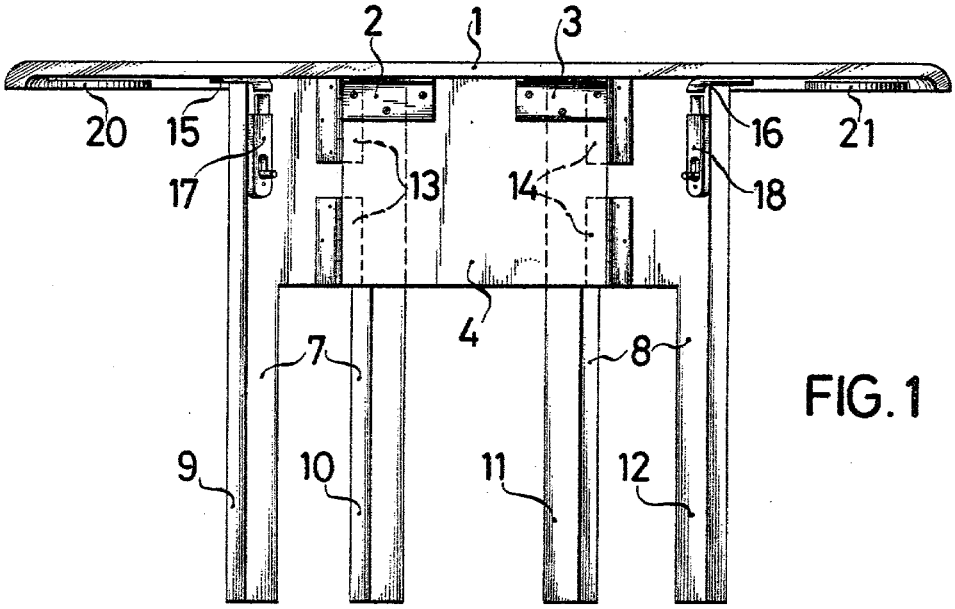
FIG. 1 is a side elevational view of the table leaf in its position for use as a side table.
Figure 2:
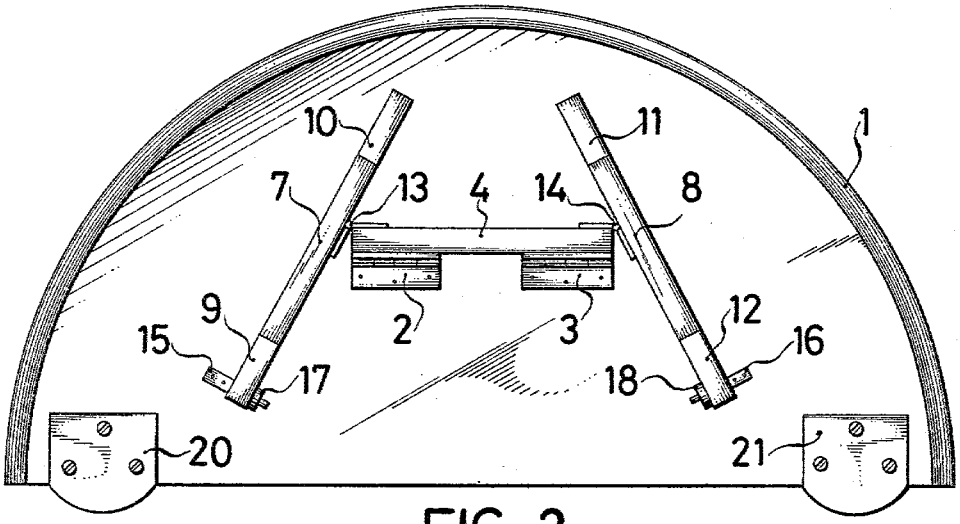
FIG. 2 is a bottom plan view of FIG. 1 showing the legs latched in a position suitable for use as a side table or bench.
Figure 3:
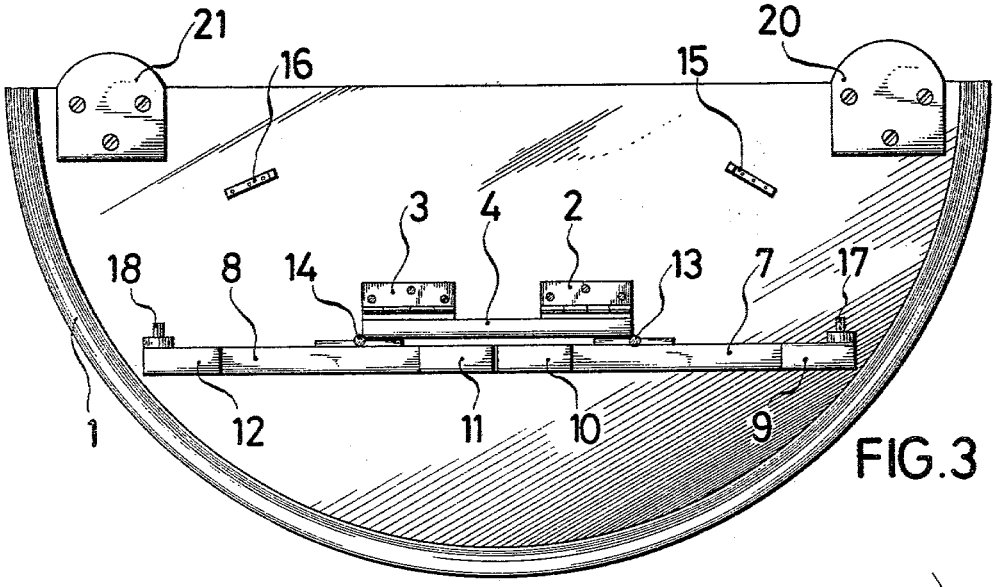
FIG. 3 is a bottom plan view of the table leaf, similar to FIG. 2, but with the legs folded into a common plane prior to insertion as slides into the end of an extension table.
Figure 4:
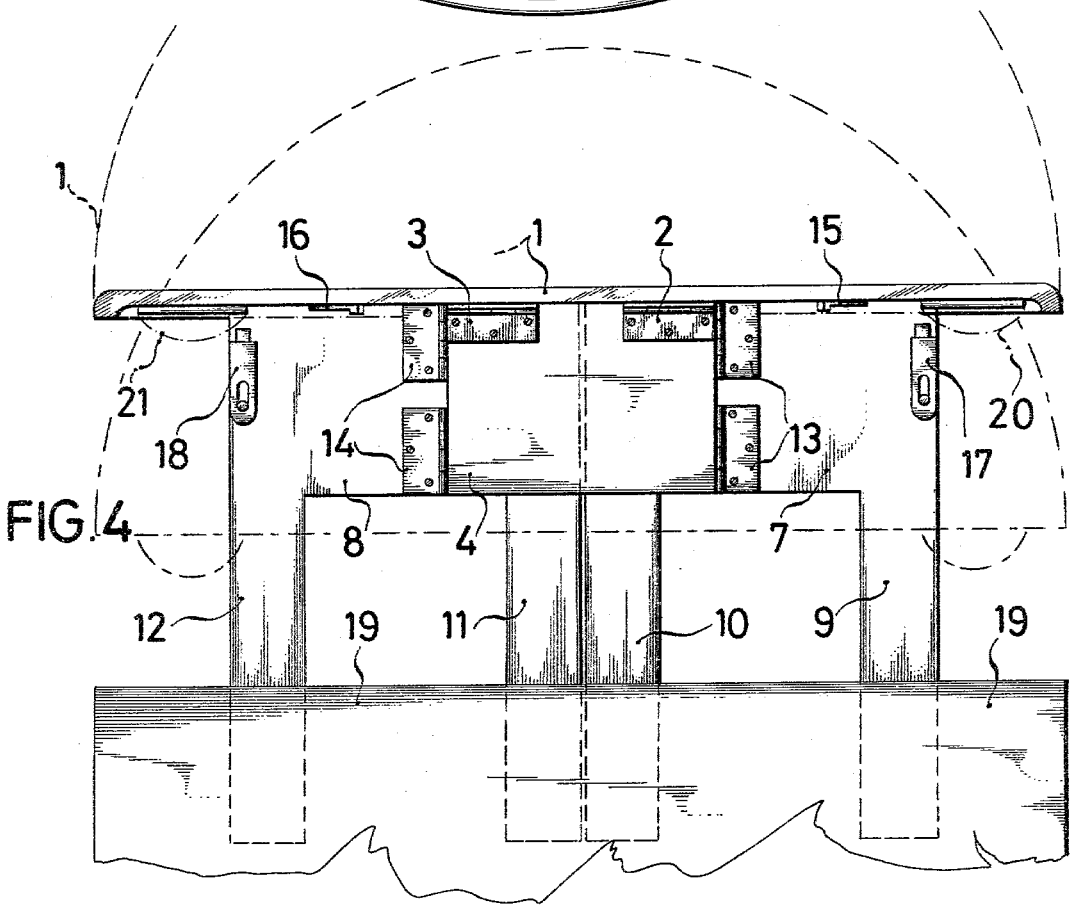
FIG. 4 is a top plan view showing a fragmentary end of an extension table with the legs of the table leaf in the position shown in FIG. 3 partly inserted as table leaf slides in the end of the extension table, and showing in dashed lines the table leaf folded to its use position as a table end leaf.
Figure 5:
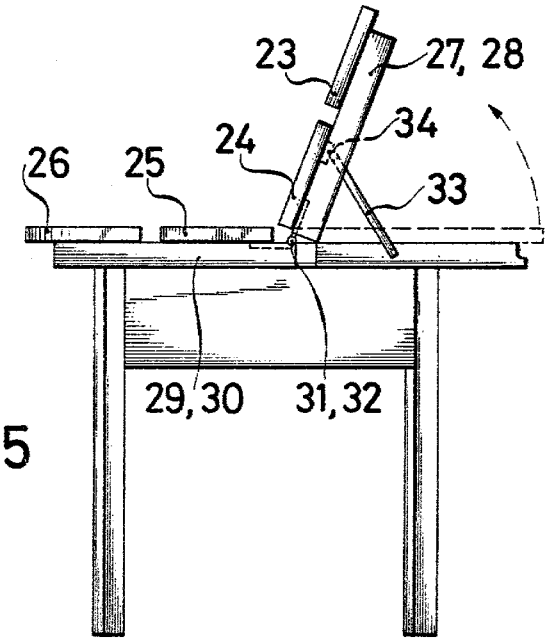
FIG. 5 is a side elevational view of a table leaf useable as a bench according to the invention.

Under pull-out table end leaf 1, auxiliary leaf or body portion 4 is attached by means of first hinges 2 and 3, immediately below the center of gravity of the end leaf and with the axes of the first hinges parallel with the edge of the leaf that corresponds to the width of the extension table 19. U-shaped supports 7 and 8, whose legs 9 to 12 are the legs of a table with four legs, are hinged to the sides of auxiliary leaf or body portion 4 by means of second hinges 13 and 14, respectively. After the table end leaf 1 is removed from the extension table 19, the end leaf 1 is pivoted 90° about the first hinges 2 and 3 from the dot dash line position shown in FIG. 4 to the full line position shown therein to bring the assembly to the position as shown in FIG. 3. In order to secure the supports 7 and 8 in the operative table or bench supporting position as shown in FIGS. 1, 2 and 5, latch plates 15 and 16 are provided under the table end leaf 1 at appropriate positions between the first hinges 2 and 3 and the edge of the leaf that abuts the end edge of the extension table. The U-shaped supports 7 and 8 are pivoted to the position shown in FIGS. 1 and 2 and latches 17 and 18, which are attached to legs 9 and 12, engage behind the catches of the latch plates and lock the U-shaped supports 7 and 8 in extended positions.

If the separate low side table or bench thus formed, as shown in FIGS. 1 and 2, is to be retracted under the end of the extension table 19, then the U-shaped supports 7 and 8 are pivoted about second hinges 13 and 14 and are brought back into the position as in FIG. 3, whereby the table leaf is maintained against the straight edge and latches 17 and 18 are pushed in. Since legs 9 and 12 of supports 7 and 8 are located further from second hinges 13 and 14 than are their legs 10 and 11, the supports will automatically collapse back into a position according to FIG. 3. In that position, legs 9 and 12 can be inserted through the end edge of the prior art extension tables 19, into the prior art leaf slide receiving assembly, not shown. When the position of the parts mentioned above is reached as in FIG. 4, then table end leaf 1 is folded back 90° from the full line position into the dot dash line position of FIG. 4. The table leaf 1 is thus brought into a position parallel with legs 9 and 12 and everything is retracted under the extension table 19. Guide plates 20 and 21 connected on the underside of end leaf 1 and extending beyond the end edge of the leaf function to hold the retracted pull-out end leaf and prevent it from rattling inside the extension table 19. By moving guide plates 20 and 21, it is possible to re-assemble two extension end leaves into a separately useable single table top with round or angular table leaf.

Figure 6:
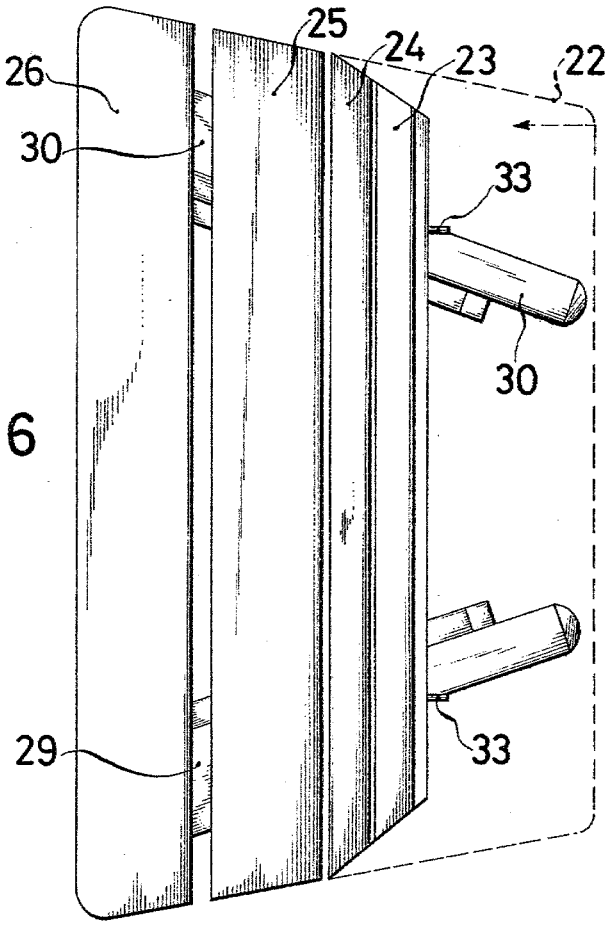
FIG. 6 is a top plan view of the same table leaf of FIG. 5.

The modified form of pull-out table end leaf according to FIGS. 5 and 6 is of trapezoidal shape 22 in top plan, rather than semi-circular in shape, and consists of four individual spaced boards 23 to 26, in which boards 23 and 24 are screwed together on auxiliary slats 27 and 28, and boards 25 and 26 are connected onto notched slats 29 and 30. Slats 29 and 30 are notched on their sides on the ends away from the extension table 19 to receive the auxiliary slats 27 and 28 therein. Boards 24 and 25 are hinged together by means of third hinges 31 and 32. Slats 27 and 28 are positioned facing the notches of notched slats 29 and 30, so that a space is created for a pivotal trapezoidal bracket 33 whose middle part can rest inside a groove 34 on the back of board 24, when boards 23 and 24 are the auxiliary slats 27 and 28 are raised about the hinges 31 and 32, and are thus locked in the raised position to form a child's bench. The arrangement of the U-shaped supports is the same as in the previously-described form of the invention.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. An extension table pull-out and separable table end leaf comprising, an end leaf body portion (1) having a table mating edge, two U-shaped supports (7,8) the legs (9–12) of which are adapted to form the legs of a table with four legs, a rectangular body portion (4) having end and side edges, first hinge means (2,3) connecting the end edge of said rectangular body portion (4) to the bottom of said end leaf body portion at the center of gravity thereof, said end leaf body portion (1) adapted to move about said first hinge means from a position substantially parallel with said rectangular body portion to a position normal thereto, second hinge means (13,14) connecting the side edges of said rectangular body portion (4) to said U-shaped supports (7,8), said U-shaped supports connected to move about said second hinge means (13,14) from positions in the same plane to extended positions at acute angles with said rectangular body portion, catch means (15,16) connected on the bottom of said end leaf body portion (1), latch means (17,18) on said U-shaped supports engageable with said catch means (15,16) to hold said U-shaped supports in the extended positions, and the legs (9–12) of said U-shaped supports (7,8) when in said same plane extending beyond the table mating edge of said end leaf body portion (1) when the latter is positioned parallel with said rectangular body portion (4) whereby said legs form slide connections with an extension table.

2. A pull-out table end leaf as set forth in claim 1, in which said first hinge means (2,3) have axes extending parallel with the table mating edge of said end leaf body portion (1).

3. A pull-out table end leaf as set forth in claim 1, in which said U-shaped supports (7,8) when in said same plane are disposed parallel with said rectangular body portion (4).

4. A pull-out table end leaf as set forth in claim 3, in which the adjacent legs (10,11) of said two U-shaped supports are positioned to almost touch each other when they are positioned in said same plane.

5. A pull-out table end leaf as set forth in claim 1, in which said rectangular body portion (4) is positioned between said end leaf body portion (1) and said two U-shaped supports (7,8) in the collapsed position of the leaf.

6. A pull-out table end leaf as set forth in claim 1, in which said second hinge means are connected to a medial portion of said U-shaped supports.

7. A pull-out table end leaf as set forth in claim 1, in which said two U-shaped supports have bight portions, and said second hinge means connected to medial portions of said bight portions.

8. A pull-out table end leaf as set forth in claim 7, in which said bight portions have a depth substantially the same as the length of said side edges of said rectangular body portion (4).

9. A pull-out table end leaf as set forth in claim 1, in which said end leaf body portion (1) having a body portion (23,24,27,28) hingedly connected thereto for movement from the plane of said end leaf body portion to an upwardly folded position, and a bracket (33) connected between said end leaf body portion (1) and said body part for maintaining the latter in propped up position.

* * * * *